United States Patent [19]

Riess

[11] Patent Number: 4,934,530

[45] Date of Patent: Jun. 19, 1990

[54] STANDING CASE FOR ELONGATED OBJECTS, ESPECIALLY DRILL BITS

[75] Inventor: Gerhard Riess, Bachhagel-Burghagel, Fed. Rep. of Germany

[73] Assignee: Firma Georg Knoblauch, Giengen/Brenz, Fed. Rep. of Germany

[21] Appl. No.: 388,821

[22] Filed: Aug. 1, 1989

[30] Foreign Application Priority Data

Aug. 13, 1988 [DE] Fed. Rep. of Germany ..... 3827546

[51] Int. Cl.[5] ..... B65D 85/20

[52] U.S. Cl. ..... 206/379; 206/45.13; 206/45.15; 312/DIG. 33

[58] Field of Search ..... 206/379, 45.15, 45.13, 206/45.24, 443, 45.23, 45.18, 45.17; 312/269, DIG. 33

[56] References Cited

U.S. PATENT DOCUMENTS

| | | | |
|---|---|---|---|
| 2,269,637 | 1/1942 | Polksnik | 206/379 |
| 2,775,342 | 12/1956 | Smith | 206/45.13 |
| 3,065,308 | 11/1962 | Suyeoka | 206/425 |
| 3,074,539 | 1/1963 | Rogovin | 206/379 |
| 4,006,821 | 2/1977 | Sautter | 206/379 |
| 4,356,918 | 11/1982 | Kahle et al. | 206/444 |
| 4,397,387 | 8/1983 | Bidegain | 206/45.23 |
| 4,496,050 | 1/1985 | Kirchner et al. | 206/45.15 X |
| 4,512,467 | 4/1985 | Knoblauch | 206/379 |
| 4,634,001 | 1/1987 | Wakelin | 206/45.15 X |
| 4,660,719 | 4/1987 | Peterson et al. | 206/379 |

FOREIGN PATENT DOCUMENTS

| | | | |
|---|---|---|---|
| 2446504 | 2/1976 | Fed. Rep. of Germany | 206/379 |
| 850798 | 10/1960 | United Kingdom | 206/379 |

*Primary Examiner*—Bryon P. Gehman
*Attorney, Agent, or Firm*—Herbert Dubno

[57] ABSTRACT

A standing case for tool bits has a stand part to which the cover part is pivotally connected and plurality of receptacles for the drilling bits which can fan out when the cover part is opened. The lower edge of each outer receptacle has a push out strip engaging the next more inwardly disposed receptacle to swing the upper part thereof outwardly. The pivot axis common to all receptacles is located in the longitudinal median plane of the rear most receptacle, close to the bottom thereof.

6 Claims, 1 Drawing Sheet

STANDING CASE FOR ELONGATED OBJECTS, ESPECIALLY DRILL BITS

FIELD OF THE INVENTION

My present invention relates to a standing case for elongated objects and, more particularly, a case in which such objects can be displayed and marketed and which later can serve for the dispensing and storage of the objects while standing on a workbench or the like. More particularly, the invention relates to a standing case for elongated objects such as tools, like spiral drill bits, screw-type drill bits or the like.

BACKGROUND OF THE INVENTION

While drill bit cases or boxes are available in a variety of configurations and can have a cover member which is swingably connected to another housing part and receptacles in the housing which can swing outwardly therefrom and into which the drill bits can be inserted, for the most part such cases are intended to lie flat upon the workbench when the case is closed. The bottom part of the case, upon opening of the cover, remains in position while the receptacles, by movement of the cover part, can be swung into a substantially vertical or upright position.

However, in the closed case, the receptacles are more or less horizontal so that the drill bits themselves lie substantially horizontally. An automatic opening of the case and fanning out of the receptacles by the weight of the drill bits contained therein is not possible.

A drawback of this system is that the case occupies a relatively large area on the worktable and generally cannot be hung on a wall.

OBJECTS OF THE INVENTION

It is, therefore, the principal object of the present invention to provide a standing case, i.e. a case whose major dimension is vertical or upright and which occupies only a minimum area of a worktable.

Another object of the invention is to provide a drill bit case with receptacles which can fan out from the housing and of an improved construction to facilitate removal of a tool therefrom.

It is also an object of this invention to provide a case of the latter type wherein automatic opening of the case by the weight of the tools therein is excluded but where the weight of the tools can improve the fanning out of the receptacles.

Still another object of this invention is to provide an improved drill bit case which is free from drawbacks of earlier systems.

SUMMARY OF THE INVENTION

These objects and others which will become apparent hereinafter in a system in which the receptacles within the drill bit case are pivotally connected to an upright housing part having a rear wall. The pivot shaft or axis for these receptacles lies substantially in a median plane through the receptacle closest to the rear wall in the region of a lower edge of the latter. The other receptacle or receptacles have lower edges which are formed with push out strips and each engage the next innermost receptacle to enable an automatic tilting out of the receptacles further inwardly, i.e. closer to the rear wall and including the rearmost receptacle.

The invention thus comprises a standing storage case for elongated objects such as spiral and screw-type drill bits, the standing case comprising:

a housing formed with a stand part having a rear wall and open in a direction opposite the rear wall in an erect position of the stand part, and a cover part pivotally connected to the stand part, the cover part being swingable from a position in which access is afforded to an interior of the housing and a position in which the interior is at least partly closed by the cover part;

a plurality of receptacles for the elongated objects in the interior of the housing and including a rearmost receptacle most proximal to the rear wall and at least one further receptacle disposed forwardly of the rearmost receptacle away from the rear wall; and pivot means defining a common pivot axis for all of the receptacles in the housing, the common pivot axis lying in a median plane of the rearmost receptacle close to a bottom edge thereof, the further receptacle being formed at its bottom with a respective strip which, upon tilting of an upper portion of the further receptacle away from the rear wall engages a respective one of the receptacles rearwardly of the one of the further receptacle and tilts the one of the receptacles away from the rear wall.

The advantage of the case of the invention is that the case can retain its substantially vertical or upright orientation both in its closed and in its open state so that the case at least at its closed state occupies a minimum of worktable area. The receptacle closest to the rear wall and which usually receives the largest and thus the heaviest tools, because of the location of its pivot axis, exerts no force on the cover part when the case is closed so that any conventional closure mechanism retaining the cover part in its closed position, for example a conventional detent, can only be acted upon, if at all, by the frontmost receptacle which usually accommodates the smallest and thus the lightest drill bit.

However, when the cover part is swung open, the torque created by the weight of the drill bits in this front most receptacle tends to swing this receptacle outwardly and thus receptacle, via its push out strip, then tilts the next innermost receptacle outwardly so that ultimately the rearmost receptacle is swung out.

According to a feature of the invention, the innermost or rearmost receptacle in its vertical position is spaced from the rear wall of the stand part of the housing in the closed case. Therefore, the top of the innermost receptacle can be tilted toward the rear wall so that a slight inclination is provided inwardly and upwardly for this receptacle and a particularly stable position is assumed thereby. This provides further assurance that the cover part will not be biased outwardly by the innermost receptacle even if the case is tilted slightly.

To facilitate fanning out of the receptacles even for standing cases of small depth, a closure part can be pivotally mounted on the stand part of the housing at the side of the stand part which is opposite the rear wall and can swing out in the same direction as the receptacles.

Advantageously this closure part is formed as a substantially rectangular closure plate with two connecting flanges bent at right angles to this cover part at opposite edges and formed with slots elongated in the longitudinal dimension of the cover plate. Pivot pins on side walls of the stand part can engage in these slots to pivotally connect the closure part to the stand part.

These pivot pins can project toward the interior or exterior of the stand part and can be sleeves open outwardly and into which pivot projections of the cover part can engage.

BRIEF DESCRIPTION OF THE DRAWING

The above and other objects, features and advantages of my invention will become more readily apparent from the following description, reference being made to the accompanying highly diagrammatic drawing in which.

SPECIFIED DESCRIPTION

Figure 2:
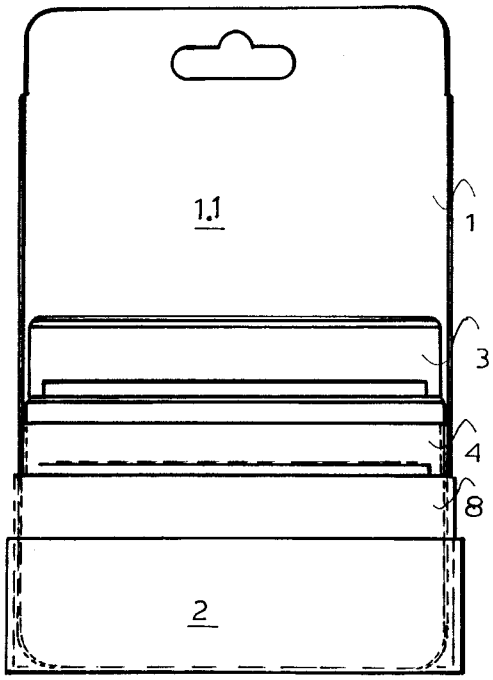
FIG. 2 is a front view of this case.

The standing case of the invention serves to store and dispense elongated objects not shown in the drawing, especially drill bits and the like.

The standing case comprises a housing having a stand part 1 which normally rests with its bottom on the workbench or table and has a cover part 2 pivotally connected therewith. The cover part has lugs 2.1 straddling the side walls of the stand part 1 pivot projections which engage in sleeves of a closure part 8 to be described in greater detail below.

Within the housing, two receptacles 3, 4 are swingably mounted. These receptacles are substantially vertical in the closed position of the case but can fan out from the stand part and can be provided with holes of different sizes in a graduated manner to receive drill bits of corresponding diameters as is conventional in the art. These bores are provided in the upper surface 3.1 and 4.1 of the receptacles 3 and 4.

A larger number of receptacles can be provided if desired.

The two receptacles 3, 4 are swingably mounted on a common pivot shaft 5 whose pivot axis lies substantially midway of the thickness of the depth of the receptacle 3, i.e. in the longitudinal median plane thereof, at a location spaced slightly above the bottom thereof. Receptacle 3 is closest to the rear wall 1.1 of the housing part 1 and thus is referred to as the innermost or rearmost receptacle.

Figure 1:
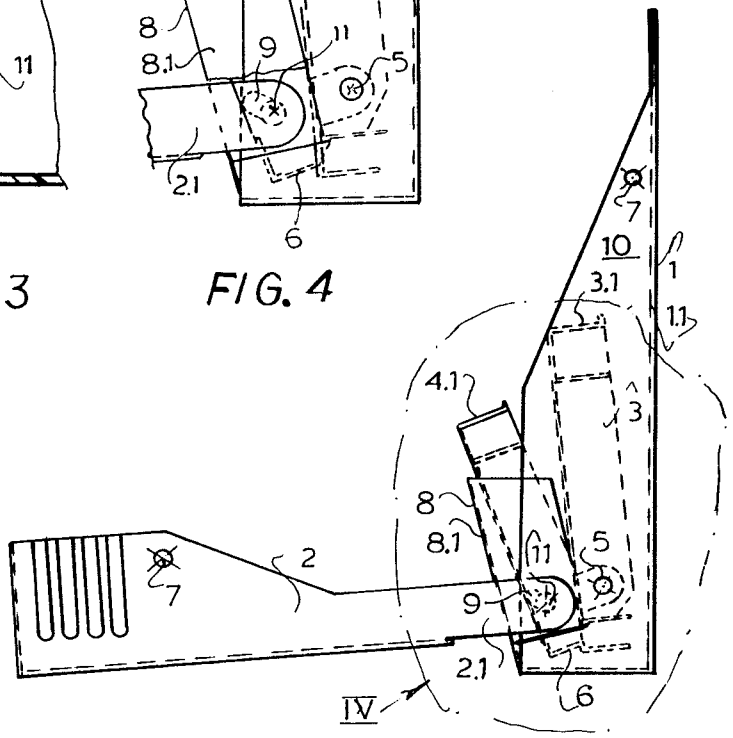
FIG. 1 is a side elevational view of a standing case according to the invention in an open position.

The further receptacle 4 is formed with a push out strip 6 at its lower edge in the use position which engages the receptacle 3 to assist in tilting this receptacle outwardly into the position shown in FIG. 1 of the drawing.

The innermost or rearmost receptacle 3 is spaced from the rear wall 1.1 in the upright position of the case so that, when the case is closed, i can be tilted slightly upwardly and inwardly or rearwardly so that it is supported against the rear wall 1.1 and thereby relieves the cover from any force contribution from the receptacle 3 or the tools contained therein in a cover opening direction.

Only the receptacle 4, therefore, will lean against the closed cover part 2 and, since it has only the lightest tools, will not tend to open the detent arrangement 7 which holds the case closed.

To improve the fanning out of the receptacles 3, 4 and thereby facilitate the removal of the tools, the housing is provided at its side opposite the rear wall 1.1 with a closure part 8 which is pivotally connected to the stand part 1 and can be swung out in the same direction as the receptacles 3, 4.

Figure 4:
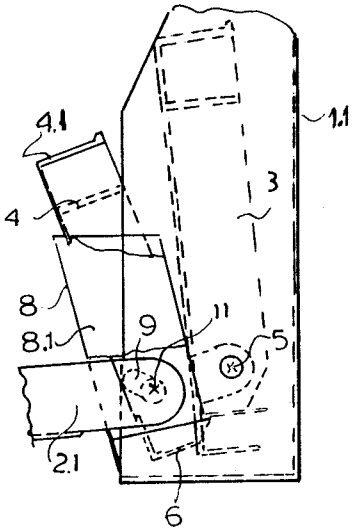
FIG. 4 is an enlarged view of area IV identified in FIG. 1 with partially exposed view of a forward receptacle behind the lateral flange of the closure part.

The closure part 8 is formed from rectangular cover plate with two lateral flanges 8.1 which are connected to opposite edges of this cover plate and extend at right angles thereto. See FIGS. 1 and 4.

The flanges 8.1 are provided with elongated slots 9.

The side walls 10 of the housing parts 1 are formed with pivot pins 11 which engage in these slots 9, the pivot pins 11 being turned inwardly (FIG. 3) when the flanges 8.1 are disposed within the side walls 10, or outwardly when the flanges 8.1 flank the side walls.

Figure 3:
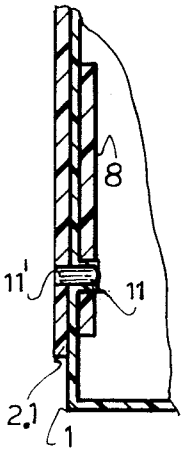
FIG. 3 is a section of the region in which the cover part and the closure part are pivotally connected to a side wall of the stand part of the housing.

As is also apparent from FIG. 3, the pins 11 can be outwardly opened sleeves in which the projections 11' of the cover part 2 engage. These sleeves can be annular bulges molded directly on the side walls.

I claim:

1. A standing storage case for elongated objects, said case capable of resting upon a horizontal surface comprising:

a housing formed with a stand part having a rear wall, a side wall, a bottom wall, and open in a direction opposite said rear wall in an erect position of said stand part, and a cover part pivotally connected to said stand part, said cover part being swingable from a position in which access is afforded to an interior of said stand part and a position in which said interior is at least partly closed by said cover part, said bottom wall being shorter in length than said side wall as well as said rear wall, said bottom wall capable of contacting said horizontal surface to rest thereon when said cover part is in said access position;

a plurality of receptacles for said elongated objects completely fitting upright within said interior of said stand part and including a rearmost receptacle most proximal to said rear wall and at least one forward receptacle disposed forwardly of said rearmost receptacle away from said rear wall; and pivot means defining a common pivot axis for all of said receptacles in said housing, said common pivot axis lying in a median plane of said rearmost receptacle close to a bottom edge thereof, said at least one forward receptacle being formed at its bottom with a respective strip which, upon tilting of an upper portion of said at least one forward receptacle away from said rear wall, engages said rearmost receptacle rearwardly of said forward receptacle and tilts said rearmost receptacle away from said rear wall.

2. The standing storage case for elongated objects defined in claim 1 wherein said rearmost receptacle, in a vertical position thereof and of said housing, is spaced from said rear wall.

3. The standing storage case for elongated objects defined in claim 1 wherein said stand part is formed on its side opposite said rear wall with a closure part pivotally connected to said stand part and swingable in a common direction with said receptacles toward and away from said rear wall.

4. The standing storage case for elongated objects defined in claim 3 wherein said closure part comprises a substantially rectangular closure plate formed on opposite edges with connecting flanges at right angles to said closure plate, said connecting flanges having slots elongated in directions of longitudinal dimensions of said flanges, said stand part being formed with said side walls having pivot members projecting therefrom and engaging in said slots.

5. The standing storage case for elongated objects defined in claim 4 wherein said pivot members are sleeves opening outwardly from said stand part, said cover part having pins extending inwardly and engaging in said sleeves.

6. The standing storage case for elongated objects defined in claim 5 wherein said rearmost receptacle, in a vertical position thereof and of said housing, is spaced from said rear wall.

* * * * *